United States Patent [19]

Sakamoto

[11] 4,167,060

[45] Sep. 11, 1979

[54] ELECTRIC SHAVER

[75] Inventor: Yoshihiro Sakamoto, Hikone, Japan

[73] Assignee: Matsushita Electric Works, Ltd., Osaka, Japan

[21] Appl. No.: 850,816

[22] Filed: Nov. 11, 1977

[30] Foreign Application Priority Data

Nov. 15, 1976 [JP] Japan ..... 51/138896

[51] Int. Cl.[2] ..... B26B 19/02

[52] U.S. Cl. ..... 30/43.92

[58] Field of Search ..... 30/43.91, 43.92, 217–220, 30/42–45, 346.51

[56] References Cited

U.S. PATENT DOCUMENTS

| | | | |
|---|---|---|---|
| 2,802,261 | 8/1957 | Heyek | 30/43.92 |
| 3,714,711 | 2/1973 | Daniels | 30/43.92 |
| 3,903,597 | 9/1975 | Cobarg | 30/43.91 |

*Primary Examiner*—Robert C. Watson

*Attorney, Agent, or Firm*—Burns, Doane, Swecker & Mathis

[57] ABSTRACT

Electric shaver of reciprocal vibration type having improved vibration member for converting rotary motion of motor into reciprocal vibrating motion of inner cutter is provided. The member comprises an integral body of a driving plate part to be coupled on one side to the inner cutter, leg parts respectively extended from each end in directions of the reciprocal vibrating motion of the plate part and flexible only in said directions, a mounting base part coupled to extended ends of the leg parts for mounting the member to stationary part in shaver housing, and an arm-shaped connecting part extended from the other side of the plate part for directly connecting it to eccentric cam of the motor at free end of the connecting part and having a flexibility in directions perpendicular to the reciprocal vibrating directions of the plate part. Components of the rotary motion of the eccentric cam directly transmitted to the connecting part of the vibration member in said perpendicular directions are absorbed by the flexibility of the connecting part, whereby the driving plate part is vibrated only in the reciprocal vibrating directions as supported by the leg parts being flexible only in such directions.

8 Claims, 12 Drawing Figures

ELECTRIC SHAVER

This invention relates generally to reciprocally vibrating type electric shavers and, more particularly, to improvements in electric shaver of a type wherein an eccentric rotary shaft driven to rotate by a driving source and a vibration member supporting an inner cutter and being supported itself reciprocally vibratably are coupled with each other by means of a cam for driving the cutter through the vibration member reciprocally vibrated with eccentric rotation of the eccentric rotary shaft.

In such an exemplary formation of practical electric shavers of the kind referred to suggested heretofore as the one shown in, for example, the U.S. Pat. No. 3,105,298, as shown schematically in FIG. 1, an eccentric pin 124 of an eccentric rotary shaft is freely engaged in a transverse slot 123 which is opened on the lower or inner surface of a cutter driving member 117 supporting a cutter 109 and longitudinally directed to directions intersecting at right angles the reciprocally vibrating direction of the cutter driving member 117 so that, in the course of its circular motion, the eccentric pin 124 alternately pushes two longitudinally sides of the slot 123 to urge the cutter driving member 117 to perform a reciprocal vibratory motion.

In such formation, specific surfaces or portions of the pin 124 opposed to the two longitudinal sides of the slot 123 repeat sliding movements under friction along the respective sides of the slot 123 and, therefore, the wear of the eccentric pin and slot's both sides is so severe that the increase of the clearance between the eccentric pin and the respective slot's sides due to such wear reduces vibrating amplitude of the cutter, renders collisions of the eccentric pin with the slot's sides to be severe and increases unfavourable vibrations and noise of shaver body.

Accordingly the present invention has been suggested to provide an electric shaver wherein the coupling of the vibrating member with the eccentric rotary shaft is made coaxial so as to solve such conventional problems as above and, more particularly, to provide an improved electric shaver wherein the eccentric rotary shaft is coaxially coupled with the vibration member at the tip of elastic arms branched from the vibration member in the reciprocally vibrating direction thereof so that displacements of the vibration member in the other direction than the inherent reciprocally vibrating direction due to the circular motion of the eccentric rotary shaft will be effectively absorbed by elastic deformation of the elastic arms and the vibration member will be caused to be driven only in the desired reciprocally vibrating direction, whereby the coaxial coupling of the vibration member with the eccentric rotary shaft can be effectively achieved and the above described conventional problems are well solved.

A primary object of the present invention is, therefore, to provide an electric shaver wherein unfavourable vibration of shaver body and noise due to uses for a long time are little.

Another object of the present invention is to provide an electric shaver wherein the load on the driving source is small.

A further object of the present invention is to provide an electric shaver with which a very smooth reciprocating motion of the cutter can be obtained.

Other objects and advantages of the present invention shall be made clear in the following description of the invention detailed with reference to certain preferred embodiments shown in attached drawings, in which:

FIGS. 1A and 1B are a side view and plan view for schematically showing an exemplary structure of main parts in the prior art referred to;

Figure 1A:
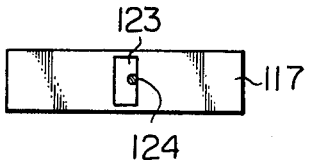
Fig. 1A PRIOR ART
Figure 1B:
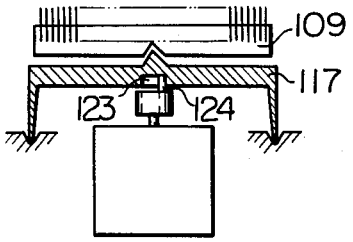
Fig. 1B PRIOR ART
Figure 2:
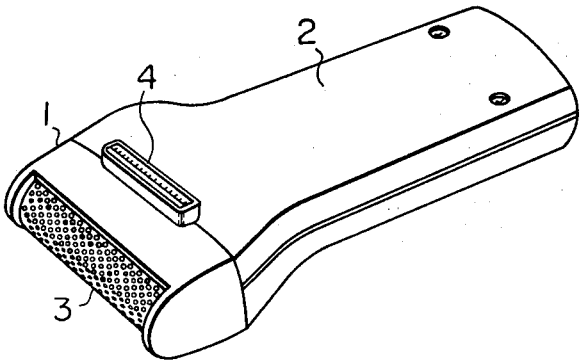
FIG. 2 is a perspective view of an electric shaver of the present invention as assembled.

In FIG. 2 showing the outer appearance of the electric shaver of the present invention, a main shaving head part 1 is fitted to a body case 2 and an outer blade 3 is fitted to said head part 1. An opening 4 for leading out a trimmer blade is provided on one side of the body case 2.

Figure 3:
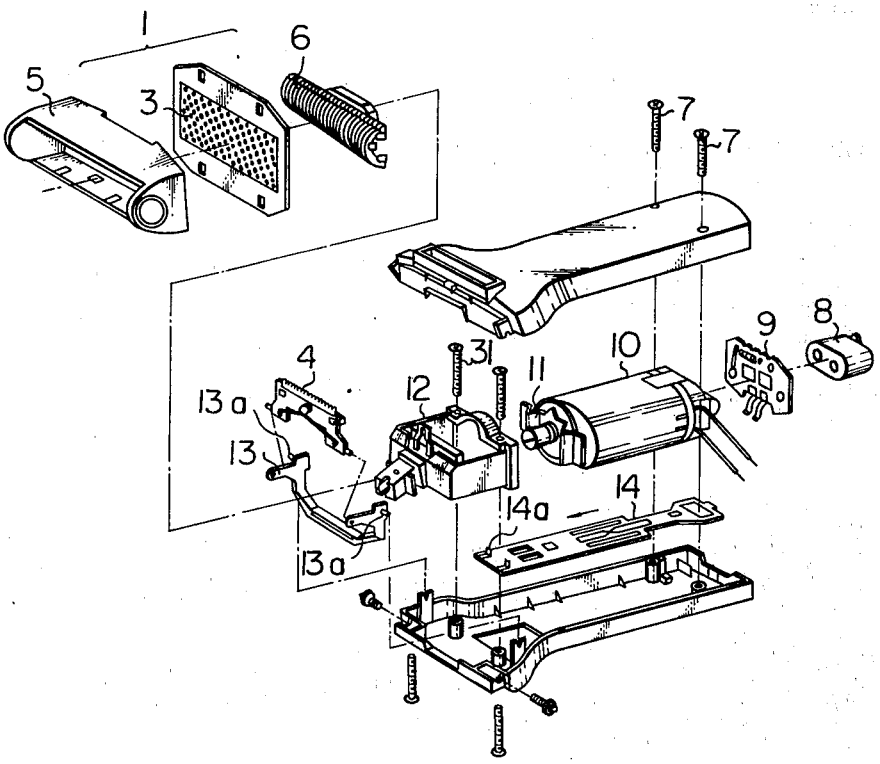
FIG. 3 is a perspective view of the shaver of FIG. 2 as disassembled into respective parts.
Figure 4:
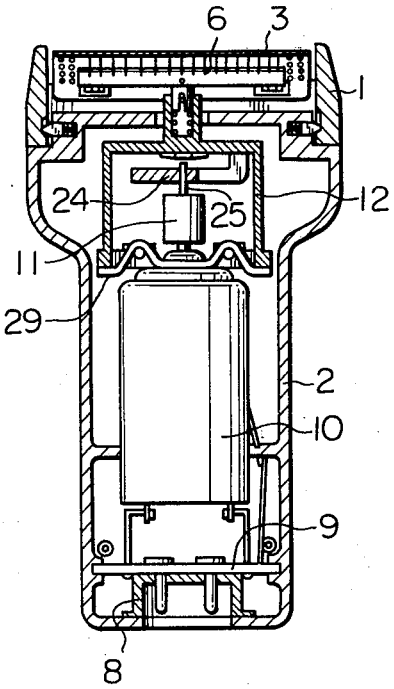
FIG. 4 is a sectioned elevation of the shaver of FIG. 2.
Figure 5:
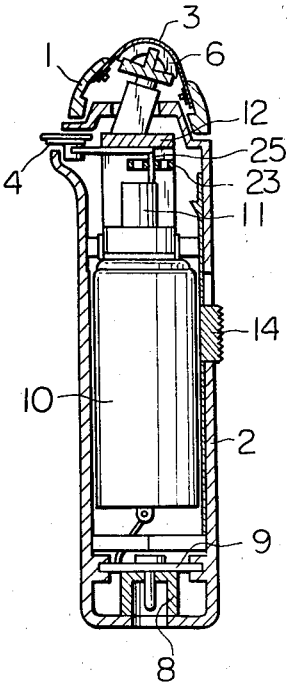
FIG. 5 is a sectioned side view of the shaver of FIG. 2.

As shown in FIGS. 3 to 5, the head part 1 of the main shaving blade is formed of a head case 5 and the outer blade 3 contained in it so that an inner cutter blade unit 6 reciprocates in its longitudinal directions sliding along the inside surface of the outer blade. The body case 2 which is formed of two split halves combined with each other with screws 7 contains, generally, a current source cord connector inserting mouthpiece 8, a terminal plate 9, a driving power source 10 of a commutating part and direct current motor, an eccentric cam 11 driven by the motor, a vibration member 12 secured to the head part of the motor 10, a trimmer blade shifting handle 13 and a switch plate 14. Screws 31 are to secure the vibration member 12 to the body case 2.

Figure 6:
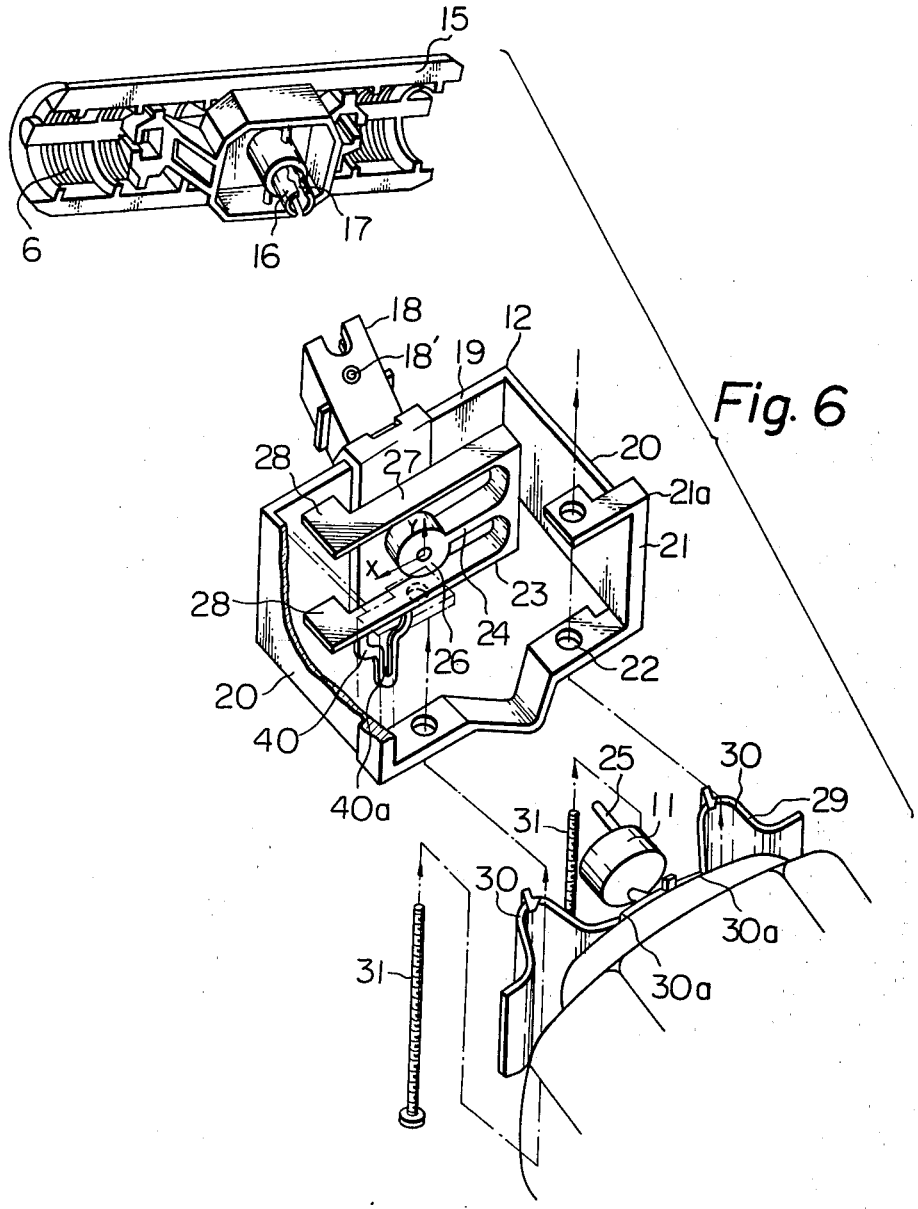
FIG. 6 is a perspective view of essential parts as disassembled of the shaver in an embodiment according to the present invention.

Referring to FIG. 6 showing an embodiment of the driving mechanism for the inner blade unit 6 as disassembled, a plurality of the inner blades of the unit 6 are fixed to an inner blade frame 15 and a substantially cylindrical connecting rod 16 is rotatably fitted adjacent its one end to a pin provided at the center of the frame 15 so as to intersect at right angles the longitudinal axis of the frame 15. The connecting rod 16 has a groove 17 extending along the longitudinal axis of the rod and opening at the other end thereof and is inserted into an axial hole of a driving bush 18 so as to be engaged at the groove 17 with a pin 18' transversely provided within the bush. Preferably the vibration member 12 is made of a plastic material and comprises a plate-shaped driving part 19 having the driving bush 18 secured to a surface of the part 19, a pair of thin plate-shaped leg parts 20 arranged in parallel with each other on both end edges of the driving plate part 19 and a relatively thick mounting base part 21 integrally formed in the lower parts of the leg parts 20. The mounting base part 21 is made into a frame shape substantially in the form of "U", having holes 22 for securing the member 12 to the body case 2 by means of screws 31 passed through the holes 22 and screwed to the inside surface of the body case 2.

A substantially E-shaped connecting part 23 is provided on the other or inner surface of the driving plate part 19 and this connecting part 23 has a hole 26 at a tip end of an inner arm 24 for freely fitting an eccentric pin 25 of an eccentric cam 11 of the power source 10, the arm 24 being projected inward from the middle of the E shape, and the connecting part 23 is integrally connected to said the other inner surface of the driving plate part 19 by bridging parts 28 contiguous to the end parts of outer arms 27 on both sides of the E shape of the connecting part 23.

A metal fitting 29 is fitted to one end or the upper part of outer case of the direct current motor 10. Inverted V-shaped projections 30 are respectively formed near the end parts on both right and left sides of the metal fitting 29. The mounting base part 21 of the vibration member 12 is fitted to these projections 30 and fixed to the inside of the shaver's body case 2 by inserting and fastening the screws 31 through the holes 22 in the member 12. In such case, both open ends 21*a* of the substantially U-shaped mounting base part 21 of the vibration member 12 are respectively pushed against stepped parts 30*a* of the metal fitting 29 so that the relatively thick mounting base part 21 is caused to be a rigid base for the vibration member 12. Then, the eccentric pin 25 of the eccentric cam 11 is inserted into the hole 26 of the arm 24.

The operation of the electric shaver of the present invention shall be explained in the following. When the eccentric cam 11 is rotated by the rotation of the motor, the eccentric pin 25 will perform a circular rotating motion, the hole 26 freely receiving therein the eccentric pin 25 will also make the same circular motion and, therefore, the motion of the eccentric pin 25 will be transmitted to the connecting part 23. This motion will be analyzed into a reciprocating motion in the direction of the X-axis and a reciprocating motion in the direction of the Y-axis. The motion in the direction of the Y-axis will be absorbed by the flexion of the connecting part 23 and only the motion in the direction of the X-axis will become effective to give the motion in the direction of the X-axis to the driving plate part 19 and to give a desired reciprocal motion to the inner blade 6 through the inner blade frame 15.

The above referred motions are as explained more in detail in the followings.

Figure 7:
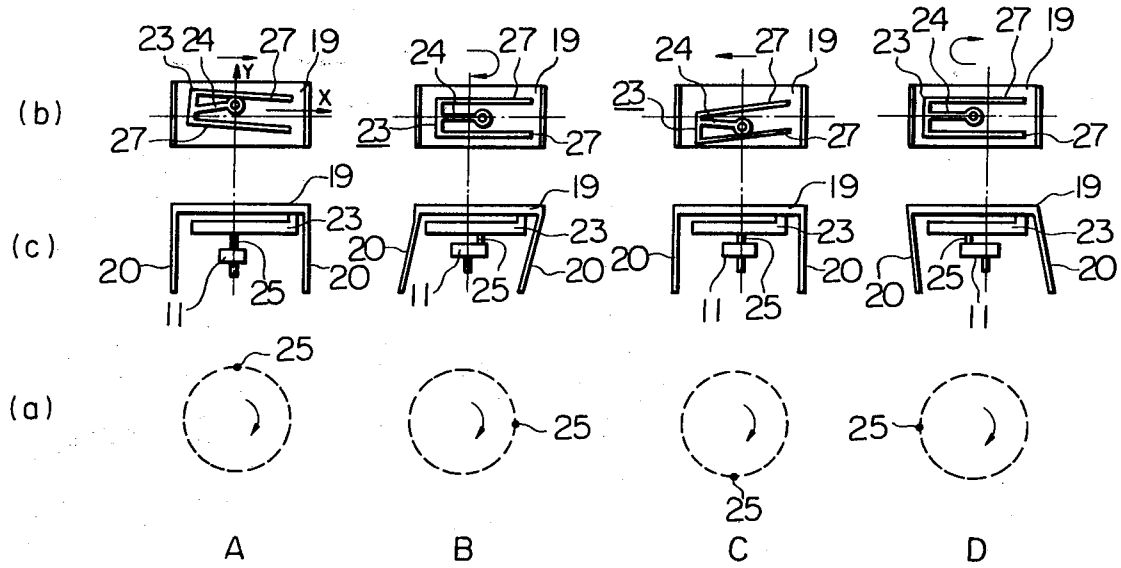
FIG. 7 is an operation explaining diagram of the embodiment of FIG. 6.

Circular diagrams of a row identified by (a) in FIG. 7 show positions of the eccentric pin 25, whereas the motions of the driving plate part 19 corresponding to respective four typical positions A, B, C and D of the pin 25 in case the pin 25 rotates in the direction indicated by the arrow are shown in respective rows (b) and (c), wherein (b) shows the driving plate as seen from below and (c) shows the same as seen from the side.

(i) In case the eccentric pin 25 is in the state of A, the thin leg parts 20 on both sides of the driving plate part 19 will not be deformed but the arms 27 and 24 of the connecting part 23 will be flexed and deformed in the direction Y by their elasticity.

(ii) When the eccentric pin 25 of the cam 11 rotates from the above described position of A to the position of B, the outer arms 27 will rotate while being deformed, the driving plate part 19 will be moved rightward in the drawing and the leg parts 20 will be deformed to reach the dead point.

(iii) When the eccentric pin 25 further rotates to the position of C, the driving plate part 19 will turn and will move leftward in the drawing and the leg parts 20 will change from the rightward flexion to the leftward flexion.

(iv) When the eccentric pin 25 rotates to the position of D, the leg parts 20 will again flex, the driving plate 19 will reach the dead point and will again turn to move rightward with the rotation of the eccentric pin 25.

The eccentric pin 25 will rotate from the state of D to the state of A so that the driving plate 19 will perform one reciprocating motion by this rotation to complete the operation of one cycle.

That is to say, during the period of the operation of one cycle, the flexing directions of the leg parts 20 and arms 24 and 27 will differ in such that, for the directions of the desired reciprocating motion of the driving plate part 19 along the longitudinal axis of the cutter unit 6, the leg parts 20 will be flexed and deformed and the arm 24 will analyze the rotating motion of the eccentric pin 25 into a motion in the particular reciprocating direction and a motion in the direction intersecting at right angles the reciprocating direction and will transmit only the desired reciprocating motion component to the driving plate, the component in the direction intersecting the reciprocating motion will become a motion in the width direction of the thin plate-shaped leg parts 20 so that the leg parts will not be deformed and the center arm 24 of the connecting part 23 will be flexed and deformed to convert the rotating motion of the eccentric pin 25 into the desired reciprocating motion of the driving plate 19.

Figure 8:
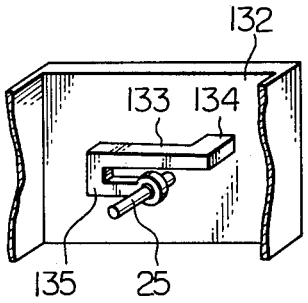
FIG. 8 is a perspective view of cutter driving member in another embodiment of the present invention.

Referring next to another embodiment of the connecting part of the vibration member as shown in FIG. 8, a substantially U-shaped arm 133 having a turned-back extension 135 is provided on the inner surface of a driving plate part 132 so that the arm 133 will be in parallel with the plate part 132, while the arm 133 is connected at one end integrally with the driving plate part 132 through a bridging part 134 and freely engaged at the other end of the extension 135 with the eccentric pin 25 of the eccentric cam. In this structure, respective sides of the arm 133 and bridging part 134 are vertical to the plane of the driving plate part 132 whereas the turned-back extension 135 extends in parallel to the plate part 132.

Figure 9:
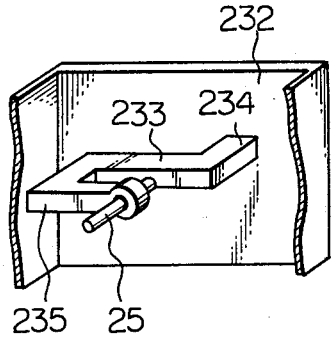
FIG. 9 is a perspective view similar to FIG. 8 of a driving member in still another embodiment of the present invention.

FIG. 9 shows still another embodiment of the connecting part of the vibration member. In this embodiment, the connecting part comprises also a substantially U-shaped arm 233 having an extension 235 turned back on a plane vertical to a driving plate part 232, so that the respective side surfaces of bridging part 234, arm 233 and extension 35 are all vertical to the lower or inner surface of a driving plate part 232.

Figure 10A:
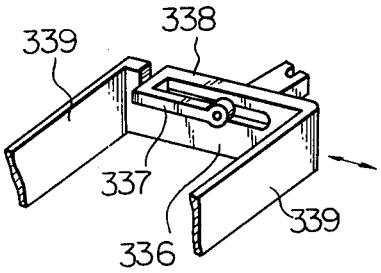
FIGS. 10A and 10B are respectively a perspective view and plan view of a driving member in still another embodiment of the present invention.
Figure 10B:
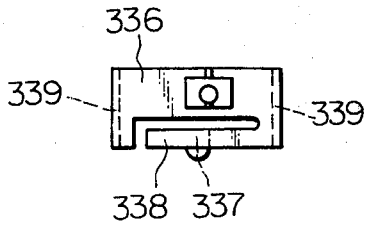

FIGS. 10A and 10B show a further embodiment of the connecting part of the vibration member, wherein an extension 337 is formed by separating a part 338 of a driving plate part 336 from its main body and turning the part 338 back vertically with respect to the plate part 336 and then in parallel to the plate part 336. A hole for engaging therein the eccentric pin (not shown here) of the cam is made at the tip of the extension 337. A pair of thin leg parts 339 are also provided at both ends of the plate part 336.

Referring again to FIG. 6, a substantially V-shaped hook part 40 for driving a trimmer 4 (see FIGS. 3 to 5)

is provided on an extension of the driving plate part 19 of the vibration member 12. The hook part 40 has a narrow slit 40*a* and, when this slit 40*a* engages with a sliding blade in the trimmer 4, the trimmer blade will be driven to slide along a stationary comb blade. When a switch plate 14 (see FIGS. 3 and 5) is moved in the direction indicated by the arrow in FIG. 3, projections 14*a* at the tip of the switch plate 14 will urge a moving handle 13 of the trimmer 4 to rotate about its pivot pins 13*a*, the trimmer 4 held rotatably between both end arms of the handle 13 will be caused to be pushed out of the body of the shaver, a driving lever of the sliding blade of the trimmer will simultaneously engage in the slit 40*a* of the hook 40 and the sliding blade of the trimmer will be thereby driven.

The features of the present invention are as follows:

(i) The rotary motion of the motor is converted to a reciprocal vibrating motion by means of the combination of the eccentric pin, connecting part with the eccentric pin, driving plate part and flexible leg parts supporting the driving plate part. As the eccentric pin is freely fitted in the hole in the connecting part, the friction between the eccentric pin and connecting part can be minimized, the clearance of the bearing part of the eccentric pin can be always kept constant and, therefore, any undesirable vibration and noise of the shaver body due to such friction are little.

(ii) As the elastic deformations of the thin leg parts integral with the driving plate part and of the flexible connecting part to the eccentric pin or cam is utilized to convert the circular motion of the eccentric pin into the linear reciprocating vibratory motion of the driving plate part, the other motion component than the reciprocating motion is absorbed by the connecting part, so that a very smooth reciprocating vibratory motion can be obtained and the undesirable frictional vibration and noise are little.

(iii) As the lower ends of the elastic legs suspended from both sides of the driving plate part 19 are fixed to predetermined positions and the connecting part in the form of elastic extended arm is connected to the lower surface of the driving plate part as turned back at least once for providing the possible longest extension and has the eccentric pin borne at the tip of the arm, the substantial length of the arm is made so long that the arm can be readily flexed in the direction Y even with a small force and the rotary motion of the eccentric pin can be smoothly and efficiently converted to the reciprocal vibratory motion.

(iv) As the tips of the thin leg parts suspended from both sides of the driving plate part of the vibration member are formed integrally with the thick mounting base part which is fixed to the case of the motor at its upper part, any noise can be prevented from being generated by the vibration of the leg parts. Further, it can be avoided to fix or unilaterally hold the thin leg parts directly on a stationary part and, therefore, the life of the electric shaver can be well elongated.

What is claimed is:

1. An electric shaver of the type comprising a shaver-body housing, a shaver head case mounted to an outer part of said housing and carrying an outer blade, an inner blade arranged to be reciprocally vibrated while in contact with an inner surface of said outer blade, a vibration member for imparting reciprocal vibratory motion to said inner blade, and rotary motion transmitting means operably connected to said vibration member for delivering drive motion from a motor to said vibration member in the form of rotary motion, the improvement wherein said vibration member comprises:

a driving plate part including a coupling part for supporting said inner blade, a pair of leg parts including inner and outer ends, the latter supporting said driving plate part, a mounting base part for connecting said inner ends of said legs to a casing of the motor with said leg parts being flexibly movable only in the directions of said reciprocal vibratory motion of said inner blade, and a connecting part comprising an arm fixedly connected at one end to an inner surface of said driving plate part, said arm including:

a first portion extending from said fixed end in one of said directions of reciprocal vibratory motion of said inner blade and substantially parallel to said driving plate parts, and a second portion joined to a free end of said first portion and extending in the other of said directions of reciprocal vibratory motion of said inner blade and substantially parallel to said driving plate part, said second portion being operably connected to said transmitting means to receive said rotary drive motion from said transmitting means, said arm being arranged so as to be flexible relative to said driving plate part only in directions perpendicular to said directions of reciprocal vibratory motion of said inner blade.

2. An electric shaver according to claim 1 wherein said driving plate part, leg parts, mounting base part, and said connecting part of said vibration member are formed integrally of a plastic material and said inner ends of said leg parts are connected to opposite ends of said driving plate part and made to be thin in said direction of the reciprocal vibration direction.

3. An electric shaver according to claim 1 wherein said connecting part comprises an E-shaped member arranged in parallel with the driving plate and including outer arms and a central arm, said central arm being integral at an end with respective free ends of said outer arms and having at the other free end a hole for receiving an eccentric pin of said power transmitting means, and said outer arms being fixed at the other ends to the lower surface of the driving plate part respectively through a bridging part.

4. An electric shaver according to claim 1 wherein said connecting part is formed of a U-shaped member of which body being extended in parallel with the driving plate part and fixed at one end to the lower surface of the driving plate part through a bridging part and having at the other free end a hole into which an eccentric pin of said power transmitting means is to be inserted.

5. An electric shaver according to claim 1 wherein said connecting part is formed of a U-shaped member of which body is arranged vertically to the driving plate part and fixed at one end to the lower surface of the driving plate part through a bridging part and has at the other free end a hole into which an eccentric pin of said power transmitting means is to be inserted.

6. An electric shaver according to claim 1 wherein said connecting part is made of a member formed by separating a part of said driving plate part from its substantial body and extending at free end downward of the driving plate part so as to be substantially L-shaped and a hole into which an eccentric pin of said power transmitting means is to be inserted is made at the other free end of said member.

7. An electric shaver according to claim 1 wherein said mounting base part fixing thereto said leg parts on both sides of said driving plate part is in the form of a box opened in a part of one side and the leg parts are coupled with both sides as opposed to each other.

8. An electric shaver according to claim 1 which further comprises a trimmer, said trimmer being supported by a handle rotated and driven by an operation of an operating member for switching on and off a current source switch and moved into and out of said housing by said operation of said operating member.

* * * * *